US007281934B2

(12) United States Patent
Aoki

(10) Patent No.: US 7,281,934 B2
(45) Date of Patent: Oct. 16, 2007

(54) CONNECTOR

(75) Inventor: Yoshitaka Aoki, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 11/599,059

(22) Filed: Nov. 13, 2006

(65) Prior Publication Data

US 2007/0066106 A1 Mar. 22, 2007

Related U.S. Application Data

(63) Continuation of application No. 11/222,878, filed on Sep. 9, 2005, now Pat. No. 7,153,149.

(30) Foreign Application Priority Data

Sep. 21, 2004 (JP) ..... 2004-273259

(51) Int. Cl.
*H01R 13/62* (2006.01)

(52) U.S. Cl. ..... 439/159; 439/630

(58) Field of Classification Search ..... 439/159, 439/630, 160, 325, 327, 328
See application file for complete search history.

(56) References Cited

U.S. PATENT DOCUMENTS 6,585,542 B2 7/2003 Nishio et al.
6,655,972 B2 12/2003 Sato
6,776,640 B2 8/2004 Nishioka
6,817,874 B2 11/2004 Okabe
6,835,077 B2 12/2004 Ikeda et al.
6,843,670 B2 1/2005 Yamaguchi et al.
6,890,195 B2 5/2005 Nagata
6,929,491 B1 8/2005 Chi-Te
7,077,705 B2 * 7/2006 Harasawa ..... 439/630
7,118,394 B2 * 10/2006 Yoneyama et al. ..... 439/159
7,118,395 B2 * 10/2006 Tsuji ..... 439/159
2002/0054964 A1 5/2002 Hartman

FOREIGN PATENT DOCUMENTS

JP 2002-124343 4/2002

* cited by examiner

*Primary Examiner*—Gary F. Paumen
(74) *Attorney, Agent, or Firm*—Robert J. Depke; Rockey, Depke & Lyons, LLC.

(57) ABSTRACT

A connector is disclosed into and from which a memory card can be inserted and removed with certainty. A slider is assembled in a slider accommodating chamber of a case body for movement among a leading end position, an intermediate position and a trailing end position. A memory card is inserted into the slider positioned at the leading end position and further pushed in to the trailing end position. Then, when the memory card is released, the slider moves to the intermediate position, at which contacts of the memory card are electrically connected to connection terminals of the connector. Then, when the memory card is pushed in, the slider is moved from the intermediate position to the trailing end position, and when the memory card is released, the slider is moved to the leading end position so as to be taken out.

14 Claims, 11 Drawing Sheets

FIG. 3A
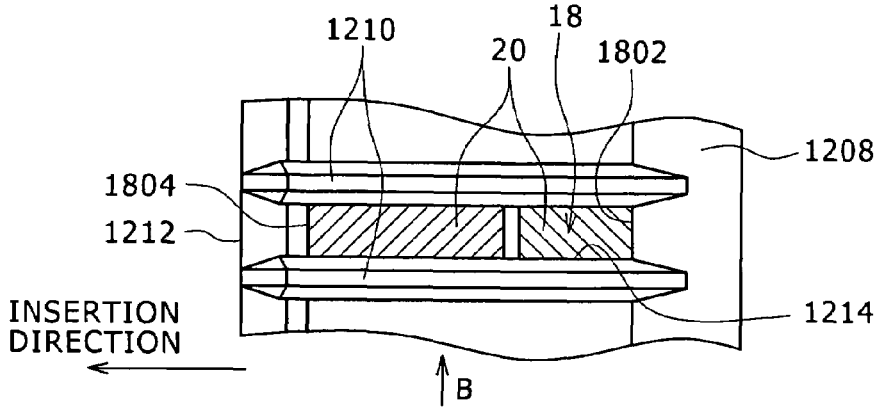
FIG. 3B
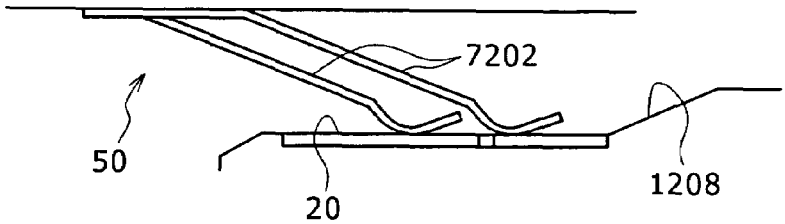
FIG. 4
| | CONTACT | | |
|---|---|---|---|
| 201 | FIRST CONTACT | Vss | |
| 202 | SECOND CONTACT | BS | |
| 203 | THIRD CONTACT | SDIO1 | SDIO5 |
| 204 | FOURTH CONTACT | SDIO0 | SDIO4 |
| 205 | FIFTH CONTACT | SDIO2 | SDIO6 |
| 206 | SIXTH CONTACT | INS | |
| 207 | SEVENTH CONTACT | SDIO3 | SDIO7 |
| 208 | EIGHTH CONTACT | SCLK | |
| 209 | NINTH CONTACT | Vcc | |
| 210 | TENTH CONTACT | Vss | |
203A
203B
204A
204B
205B
205A 70
58
10
6004
6202,
6204
62
60
6612
54
64
6604
66
6602
6606
1224
6204
1220
6206
6610

CONNECTOR

The subject matter of application Ser. No. 11/222,878 is incorporated herein by reference. The present application is a continuation of U. S. application Ser. No. 11/222,878, filed Sep. 9, 2005 now U.S. Pat. No. 7,153,149, which claims priority to Japanese Patent Application No. 2004-273259, filed Sept. 21, 2004. The present application claims priority to these previously filed applications.

BACKGROUND OF THE INVENTION

This invention relates to a connector for a memory card.

A connector has been provided into which a memory card is inserted which includes a case in which parts which form a memory are accommodated, a contact region provided at a leading portion of the case in an insertion direction into the connector such that it extends in a direction perpendicular to the insertion direction and a plurality of contacts juxtaposed in the perpendicular direction to the insertion direction and extending in the insertion direction.

One of connectors of the type described above includes a mechanism for fitting and removing a memory card by push-in and push-out operations. According to the mechanism mentioned, when a memory card is to be fitted into the connector, it is pushed in the insertion direction into the connector (push-in operation) until the contacts of the memory card and connection terminals of the connector are connected to each other. Then in this state, the memory card is locked to the connector. Then, when the memory card is to be removed from the connector, the memory card connected to the connector is pushed in the insertion direction, whereupon the memory card is unlocked from the connector thereby to allow the memory card to be removed (push-out operation). A connector of the type described is disclosed in Japanese Patent Laid-open No. 2002-124343 (hereinafter referred to as Patent Document 1).

In particular, where the position of the memory card in the insertion direction when the memory card is connected to the connector is referred to as ordinary use position, when the memory card is fitted into the connector (upon push-in operation) and when the memory card is removed from the connector (upon push-out operation), the memory card is moved by a predetermined dimension (for example, approximately 1 to 2 mm) in the insertion direction from the ordinary use position. The predetermined distance is necessary for the mechanism to operate.

SUMMARY OF THE INVENTION

Incidentally, it is a possible idea to divide, as seen in FIG. 12A, each contact 20 of a memory card 10 into two contact portions 22 in the direction perpendicular to the insertion direction without varying the length in the insertion direction of the contact 20 such that the contact portions 22 are provided in a juxtaposed relationship in the insertion direction to increase the number of signal lines to be used for transmission of signals between the memory card 10 and a connector 50. In this instance, as seen in FIG. 12B, also for connection terminals 52 of the connector 50, connection terminals having a comparatively great length and connection terminals having a comparatively small length are provided corresponding to the contact portions 22 at locations individually corresponding to the locations at which the contact portions 22 are provided.

According to the configuration just described, since the length of the contact portions 22 is reduced from that of the contacts 20, it cannot be avoided to reduce the distance over which the memory card 10 can be moved in the insertion direction after it is inserted into the connector 50 by an amount corresponding to the length by which the length of the contact portions 22 is reduced.

Therefore, it is sometimes difficult to assure the predetermined dimension necessary to allow the mechanism to function, that is, a stroke necessary for the mechanism to perform push-in and push-out movements.

This gives rise to, for example, such a disadvantage that, if the memory card 10 is moved by the predetermined distance necessary for the mechanism to function as seen in FIGS. 13A and 13B, then the connection terminals 52 of the connector 50 move away from the contact portions 22 of the memory card 10 and ride on case portions of the memory card 10.

Accordingly, if a configuration is taken that each contact 20 of the memory card 10 is divided to form two contact portions 22 to increase the number of signal lines which can be used for transmission, then it is likely to be difficult to assure, in the connector 50, the predetermined dimension necessary for the fitting/removing apparatus to function. Thus, the configuration described is disadvantageous where it is tried to perform fitting and removing of the memory card 10 into and from the connector 50 by push-in and push-out operations with certainty.

It is an object of the present invention to provide a connector which is advantageous in fitting and removing of a memory card into and from the connector by push-in and push-out operations even where a plurality of contacts are not provided uniformly on the memory card.

The object of the present invention just described is achieved by providing a connector with a slider into which a memory card is inserted.

In particular, according to the present invention, there is provided a connector having a plurality of connection terminals for contacting with a plurality of contacts of a contact region of a memory card, including a case body, a slider accommodating chamber provided on the case body, the case body having an opening for the slider accommodating chamber thereon, a slider disposed in the slider accommodating chamber for movement between the opening and an interior location opposing to the opening, a first restriction section for restricting a leading end position at which the slider faces the opening in the slider accommodating chamber, a second restriction section for restricting a trailing end position at which the slider faces a location rather near to the interior location in the slider accommodating chamber, a biasing section for biasing the slider toward the leading end position, a locking mechanism provided between the case body and the slider for moving, when the slider is pushed in from the leading end position to the trailing end position, the slider forwardly from the trailing end position until the slider is locked at an intermediate position between the leading end position and the trailing end position and for canceling the locking when the slider is pushed in again from the intermediate position, a memory card accommodating chamber provided on the slider for receiving the contact region of the memory card inserted therein, the case body having an insertion opening for the memory card into the memory card accommodating chamber provided so as to face the inner side of the opening when the slider is positioned at the leading end position, a retaining mechanism provided on the slider for retaining, when the contact region of the memory card is inserted into the memory card accommodating chamber, the inserted state of the contact region of the memory card, a plurality of slider side contacts provided in the memory card accommodating chamber for contacting, when the contact region of the memory card is inserted in the memory card accommodating chamber, individually with the contacts of the contact region of the memory card, and a connection mechanism provided in the slider accommodating chamber for electrically connecting the connection terminals and the slider side contacts individually to each other.

According to the connector, in the state wherein the memory card is inserted in the memory card accommodating chamber of the slider, the contacts of the memory card and the slider side contacts of the memory card accommodating chamber are electrically connected to each other with certainty. Then, the slider performs push-in and push-out movements while the slider and the memory card do not move relative to each other, and upon the push-in and push-out movements, the slider side contacts of the memory card accommodating chamber and the connection terminals of the connector are always held in electric connection to each other through the connection mechanism.

Accordingly, even where a memory card in which a plurality contacts are not disposed uniformly is used, insertion and removal of the memory card into and from the connector by push-in and push-out operations can be performed with certainty while electric connection between the contacts of the memory card and the connection terminals of the connector is maintained with certainty.

The above and other objects, features and advantages of the present invention will become apparent from the following description and the appended claims, taken in conjunction with the accompanying drawings in which like parts or elements denoted by like reference symbols.

BRIEF DESCRIPTION OF THE DRAWINGS

FIG. 3A is a plan view illustrating a relationship between contacts of the memory card of FIG. 1 and contact portions of a connector to which the present invention is applied, and FIG. 3B is a view as viewed in the direction indicated by an arrow mark B in FIG. 3A;

FIG. 4 is a view illustrating signals allocated to the contacts of the memory card of FIG. 1;

DETAILED DESCRIPTION OF THE PREFERRED EMBODIMENTS

First Embodiment

A connector according to a first embodiment of the present invention is described first.

First, a memory card adapted to be fitted into the connector is described.

Figure 1:
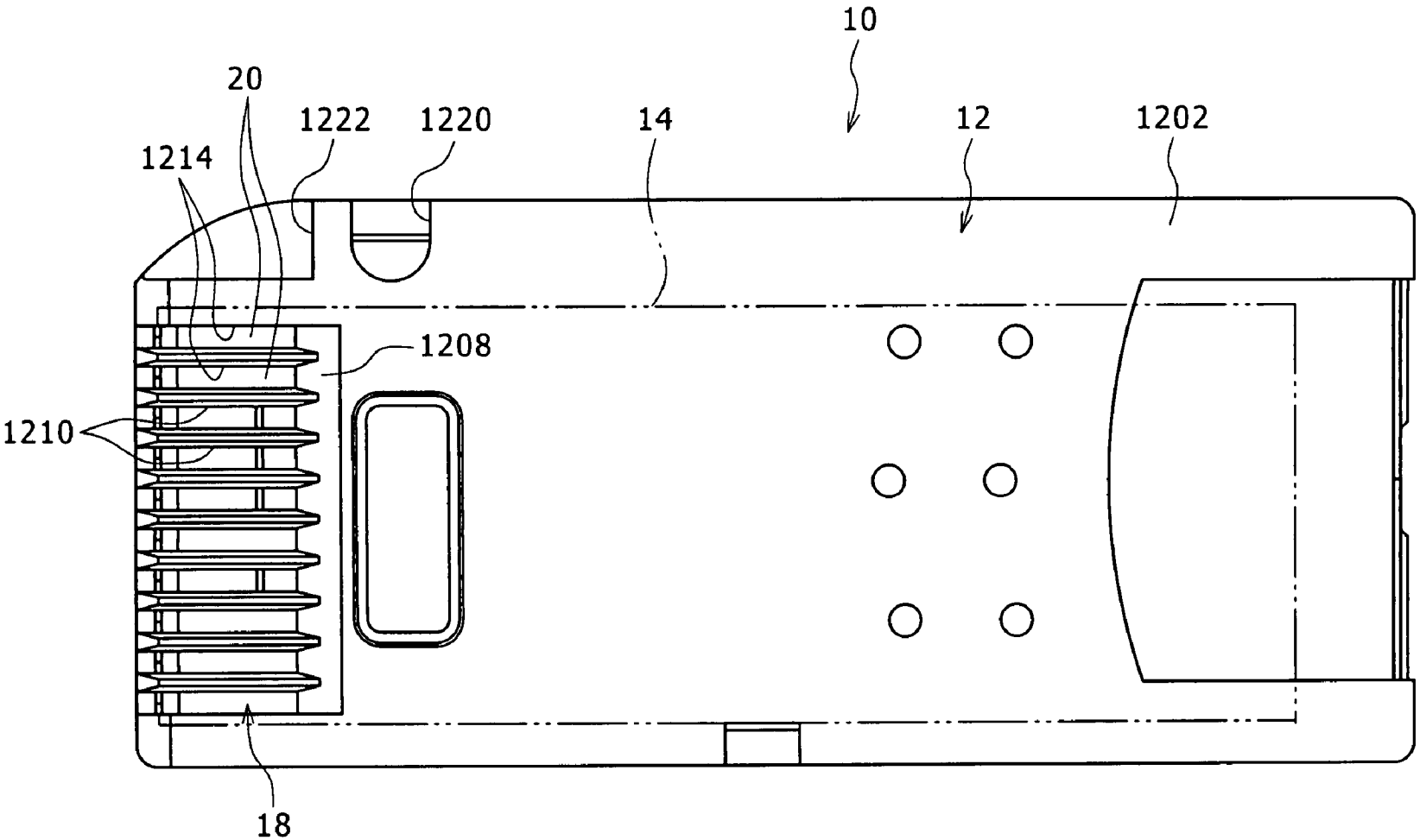
FIG. 1 is a bottom plan view of a memory card.

Referring first to FIG. 1, the memory card is shown and denoted by reference numeral 10. The memory card 10 includes a case 12, and a printed board 14 accommodated in an internal space defined by the case 12.

The memory card 10 has a thickness, a width of a dimension greater than that of the thickness, and a length of a dimension greater than that of the width. The direction of the length of the memory card 10 is a direction in which the memory card 10 is inserted into the connector, that is, an insertion direction.

The printed board 14 includes several parts which form a memory including an insulating circuit board, a memory chip mounted on the insulating circuit board, electronic parts which form a control circuit for controlling inputting and outputting operation of data to and from the memory chip and for performing other necessary control, a switch for inhibiting writing into the memory chip and so forth, all not shown.

A contact region 18 is formed at one end of the printed board 14 in the lengthwise direction (a leading end portion of the contact region 18 into the connector in the insertion direction) such that it extends in a direction perpendicular to the lengthwise direction. A plurality of contacts 20 hereinafter described are provided in the contact region 18.

Figure 2:
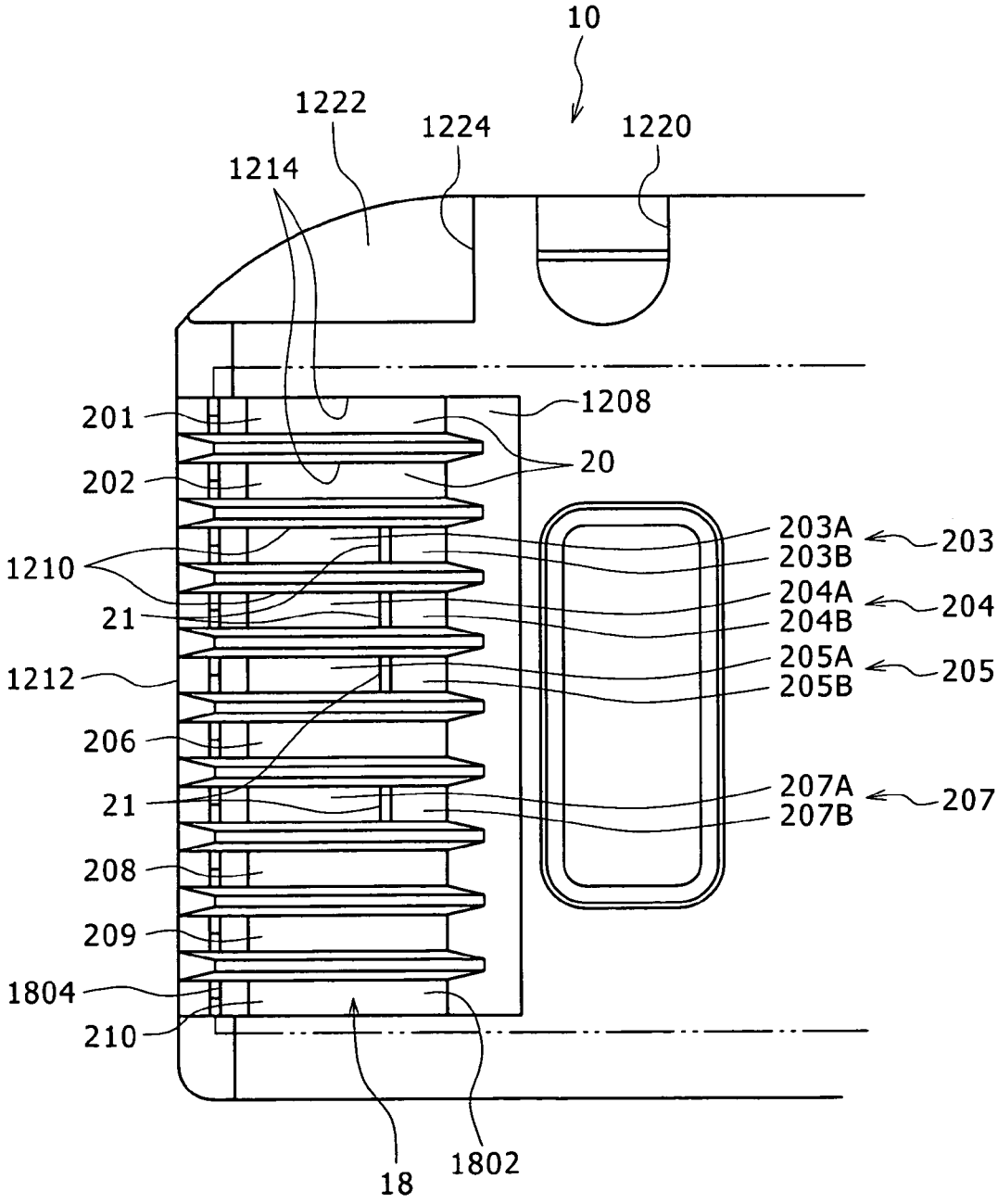
FIG. 2 is an enlarged view of part of the memory card of FIG. 1.

Referring to FIG. 2, an engaging recessed portion 1220 is formed at a location of a lower face 1202 at one of end portions in the widthwise direction of the case 12 rather near to a leading end in the insertion direction such that it is open outwardly in the widthwise direction.

Further, a recessed portion 1222 for a reference face is formed at a location on the lower face 1202 of the case 12 nearer to the leading end in the insertion direction than the engaging recessed portion 1220 such that it is open outwardly in the widthwise direction. A portion of a side portion of the recessed portion 1222 is formed as a reference face 1224 which extends along the widthwise direction of the case 12 and faces in the insertion direction. The reference face 1224 is used as a reference for various dimensions of the case 12 in the insertion direction.

A plurality of partition walls 1210 are disposed in a spaced relationship from each other in the widthwise direction at a leading end portion of the lower face 1202 of the case 12 in the insertion direction such that they extend in the lengthwise direction. A portion of the case 12 between each adjacent ones of the partition walls 1210 serves as an opening 1214 which extends in the lengthwise direction (insertion direction).

More particularly, a plurality of partition walls 1210 are provided in a spaced relationship from each other in the direction perpendicular to the lengthwise direction (insertion direction) and extend from a base portion 1802 to a tip portion 1804 of the contact region 18.

Referring to FIGS. 2, 3A and 3B, base ends of the partition walls 1210 are connected to each other by an inclined face 1208 which extends in the widthwise direction. The inclined face 1208 is connected to the lower face 1202.

Further, upper faces of front ends of the partition walls 1210 are connected to each other by a connecting wall 1212 of a small thickness.

Accordingly, the contact region 18 is disposed at an end portion of the memory card 10 in the lengthwise direction (leading end portion in the insertion direction) across the openings 1214 between the partition walls 1210 juxtaposed in a spaced relationship from each other in the direction perpendicular to the insertion direction into the connector.

Referring to FIG. 2, a plurality of contacts 20 are provided in the contact region 18 such that they are juxtaposed in the direction perpendicular to the lengthwise direction and individually extend in the lengthwise direction.

In particular, as seen in FIG. 2, the contacts 20 include first to tenth contacts 201 to 210.

The contacts are used for such signals as seen in FIG. 4.

Referring to FIG. 4, the first contact 201 and the tenth contact 210 are Ground contacts connected to the ground level (Vss).

The second contact 202 is used to receive a bus state signal BS representative of a delimiter of data communicated by data signals SIDO0 to SIDO7.

The eighth contact 208 is a clock input contact to which a clock signal SCLK is inputted. The bus state signal BS and the data signals SIDO0 to SIDO7 are communicated in synchronism with the clock signal SCLK.

The ninth contact 209 is a power supply input contact to which a power supply Vcc is inputted.

The sixth contact 206 is an insertion/removal detection contact and is used to communicate an INS signal which is used for detection of insertion/removal of a memory card by the external apparatus described hereinabove but is not used for data communication.

The third contact 203, fourth contact 204, fifth contact 205 and seventh contact 207 are data signal input/output contacts for inputting and outputting the data signals SIDO0 to SIDO7 of the 8-bit parallel type. The third contact 203, fourth contact 204, fifth contact 205 and seventh contact 207 are formed from first contact portions 203A, 204A, 205A and 207A and second contact portions 203B, 204B, 205B and 207B separated in the direction perpendicular to the lengthwise direction (insertion direction into a connector), respectively. The first contact portions 203A, 204A, 205A and 207A and the second contact portions 203B, 204B, 205B and 207B are separated from each other by a gap 21 extending in the direction perpendicular to the lengthwise direction.

More particularly, the third contact 203 is formed from the first contact portion 203A for inputting and outputting the data signal SIDO1 and the second contact portion 203B for inputting and outputting the data signal SIDO5.

The fourth contact 204 is formed from the first contact portion 204A for inputting and outputting the data signal SIDO0 and the second contact portion 204B for inputting and outputting the data signal SIDO4.

The fifth contact 205 is formed from the first contact portion 205A for inputting and outputting the data signal SIDO2 and the second contact portion 205B for inputting and outputting the data signal SIDO6.

The seventh contact 207 is formed from the first contact portion 207A for inputting and outputting the data signal SIDO3 and the second contact portion 207B for inputting and outputting the data signal SIDO7.

Accordingly, a contact 20 faces an opening 1214 between each adjacent ones of the partition walls 1210 such that the single contact 20 faces, in the opening 1214, each of the first contact 201, second contact 202, sixth contact 206, eighth contact 208 and tenth contact 210 while, as regards the four contacts 20 of the third contact 203, fourth contact 204, fifth contact 205 and seventh contact 207, two contact portions of the first contact portion 203A, 204A, 205A or 207A and the second contact portion 203B, 204B, 205B or 207B separated from each other in the direction perpendicular to the insertion direction face in the opening 1214.

Now, the connector according to the present embodiment is described.

Referring to FIG. 5, the connector 50 according to the present embodiment includes a case body 54, a slider accommodating chamber 56, a slider 58, a memory card accommodating chamber 60, a retaining mechanism 62, a biasing element 64 (FIGS. 9A to 10D), a locking mechanism 66 (FIGS. 9A to 10D), and a plurality of connection terminals 74.

The slider 58 is assembled in the slider accommodating chamber 56 of the case body 54 for movement between a leading end position and a trailing end position. The memory card 10 is inserted into the slider accommodating chamber 56 of the slider 58 positioned at the leading end position and is pushed as it is until the slider 58 comes to the trailing end position. Then, if the user releases the memory card 10, then the slider 58 is locked at an intermediate position between the leading end position and the trailing end position by the locking mechanism 66. At the intermediate position of the slider 58, the contacts 20 of the memory card 10 and the connection terminals 52 of the connector 50 are electrically connected to each other individually. If the user pushes the memory card 10 in again, then the locking is canceled, and then if the user releases the memory card 10, then the slider 58 is positioned at the leading end position, at which the memory card 10 can be taken out from the slider 58.

More particularly, the case body 54 includes a bottom wall 5402 in the form of a rectangular plate, a pair of left and right side walls 5404 extending uprightly from two opposing sides of the bottom wall 5402, and a rear wall 5406 extending uprightly from one of the remaining two sides of the bottom wall 5402 positioned between the first-mentioned two sides.

The two side walls 5404 of the case body 54 extend along the insertion direction of the memory card 10, and the rear wall 5406 is positioned on the interior side in the insertion direction.

The slider accommodating chamber 56 is defined by the bottom wall 5402, two side walls 5404 and rear wall 5406 of the case body 54.

A portion of the slider accommodating chamber 56 rather remote from the rear wall 5406, that is, a leading end of the slider accommodating chamber 56, forms an opening 5602 through which the slider accommodating chamber 56 is opened, and a location of the slider accommodating chamber 56 rather near to the rear wall 5406 forms an interior portion 5604 of the slider accommodating chamber 56.

Figures 9A, 9B, 9C, 9D:
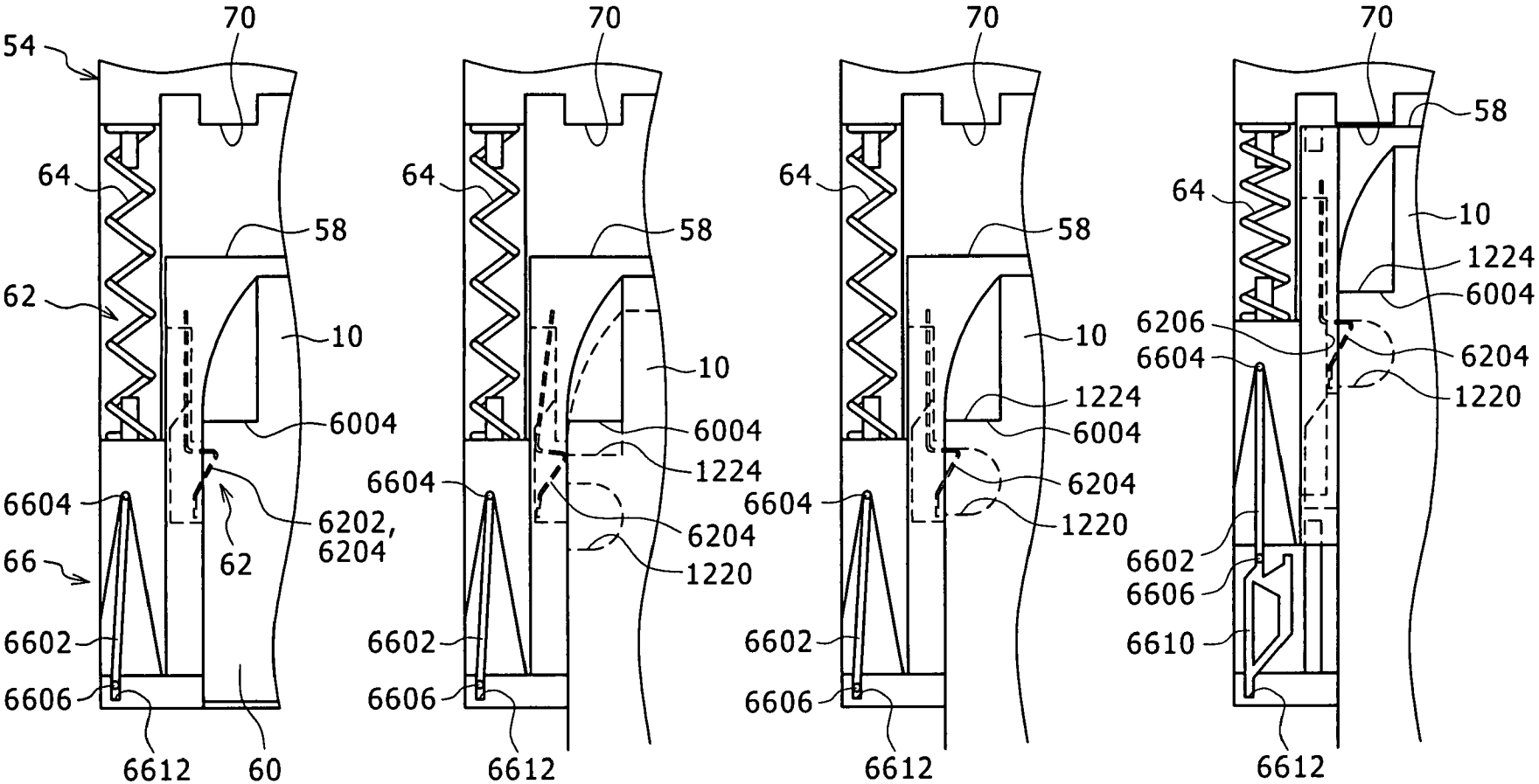
FIGS. 9A to 9D are schematic views of the connector of FIG. 3A when the memory card of FIG. 1 is fitted into the connector.
Figures 10A, 10B, 10C, 10D:
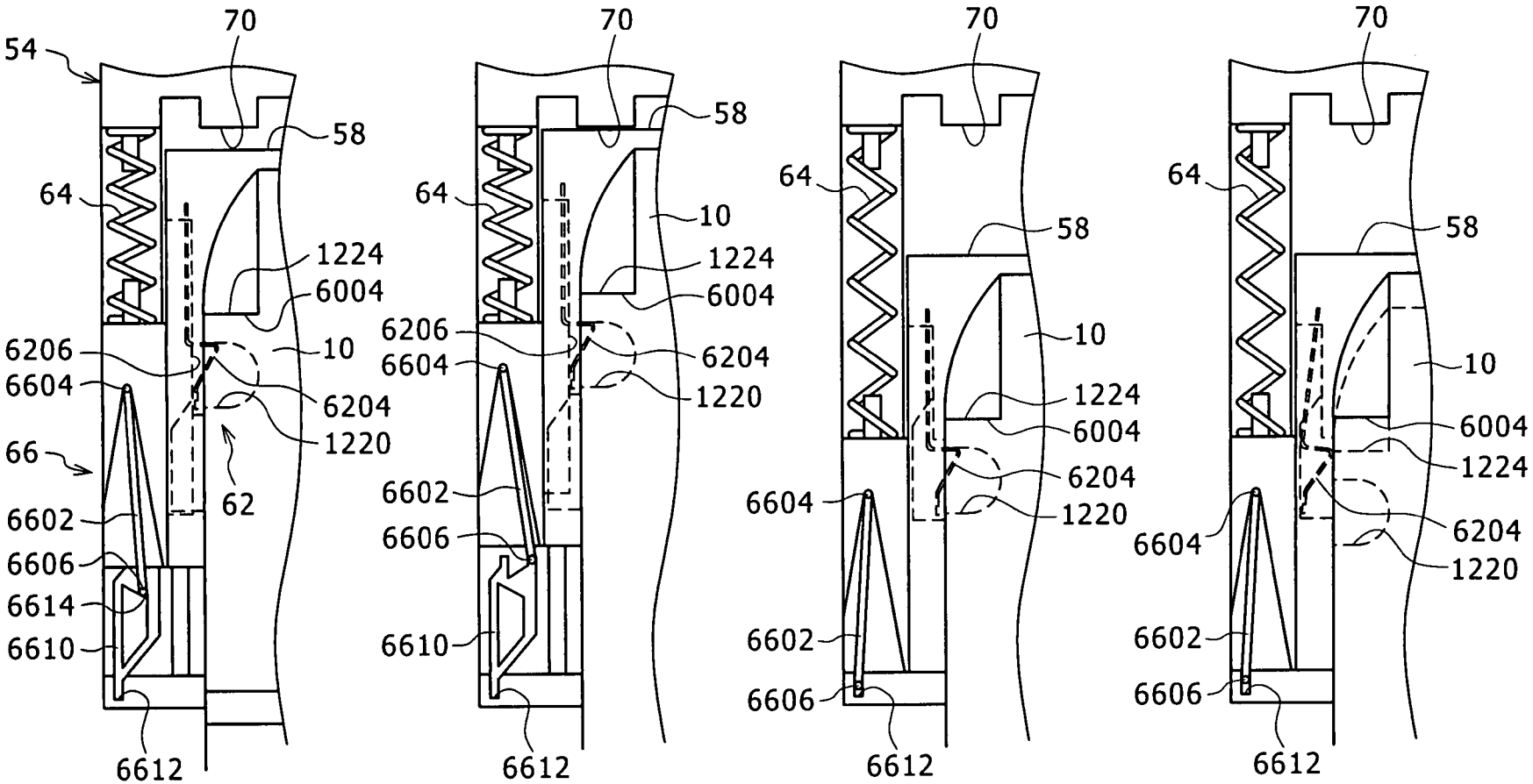
FIG. 10A is a schematic view of the connector of FIG. 3A when the memory card of FIG. 1 is fitted into the connector and FIGS. 10B to 10D are similar views but showing the connector when the memory card is removed from the connector.

Further, two stoppers 70 are provided at locations of the case body 54 rather near to the opposite ends in the extending direction of the rear wall 5406 as seen in FIGS. 9D and 10D. In other words, the stoppers 70 are provided in the slider accommodating chamber 56, and the slider 58 contacts with the stoppers 70 such that it is positioned at the trailing end position at which it faces the location rather near to the interior portion 5604.

The memory card accommodating chamber 60 into which the contact region 18 of the memory card 10 is inserted is provided on the slider 58. Further, an insertion opening 6202 for the memory card 10 into the memory card accommodating chamber 60 is provided on the slider 58.

More particularly, the slider 58 includes a bottom wall 5802, a pair of left and right side walls 5804 extending uprightly from two opposing sides of the bottom wall 5802, a rear wall 5806 extending uprightly from one of the remaining two sides of the bottom wall 5802 positioned between the first-mentioned two sides, and a upper wall 5808 extending in parallel to the bottom wall 5802 and interconnecting upper portions of the two side walls 5804 and the rear wall 5806. The memory card accommodating chamber 60 is defined by the bottom wall 5802, two left and right side walls 5804, rear wall 5806 and upper wall 5808, and a location of the memory card accommodating chamber 60 which faces the rear wall 5806 is formed as the insertion opening 6202.

A reference face 6004 is formed on one of the side walls 5804 of the slider 58, that is, in the memory card accommodating chamber 60 such that it contacts with the reference face 1224 of the memory card 10 inserted into the memory card accommodating chamber 60.

The slider 58 is supported for movement in the insertion direction such that the two side walls 5804 thereof are guided by the two side walls 5404 of the case body 54 while the bottom wall 5802 thereof is placed on the top face of the bottom wall 5402.

The slider 58 has the retaining mechanism 62 provided thereon for retaining, when the contact region 18 of the memory card 10 is inserted in the memory card accommodating chamber 60, the contact region 18 of the memory card 10 in the inserted condition.

The retaining mechanism 62 includes a spring member 6202.

The spring member 6202 is secured at a base end thereof to the outer face of one of the side walls 5804 of the slider 58 and has a locking portion 6204 provided at the other end thereof such that it projects into the memory card accommodating chamber 60 through an opening provided in the side wall 5804. The locking portion 6204 is disposed for resilient deformation in the widthwise direction of the memory card 10 such that, when the contact region 18 of the memory card 10 is inserted in the memory card accommodating chamber 60 (more particularly, when the reference face 1224 of the memory card 10 contacts with the reference face 6004 in the memory card accommodating chamber 60), the locking portion 6204 is lockably engaged with the engaging recessed portion 1220 of the memory card 10.

Further, an abutting wall 6206 is provided at a location of the side wall 5404 of the case body 54 facing the spring member 6202, that is, on a side face which defines the memory card accommodating chamber 60. The abutting wall 6206 is abutted, when the slider 58 is positioned at the intermediate position, with the spring member 6202 to block resilient deformation of the spring member 6202 in the widthwise direction thereby to keep the locking of the locking portion 6204 of the spring member 6202 by the engaging recessed portion 1220.

The biasing element 64 is formed from, for example, a coil spring as seen in FIGS. 9A to 9D and is interposed between the rear wall 5406 of the case body 54 and one of the side walls 5804 of the slider 58 to bias the slider 58 toward the opening 5602.

As described hereinabove, the slider accommodating chamber 56 is adapted to lock the slider 58 at the intermediate position or cancel the locking of the slider 58 at the intermediate position and is formed from a locking arm 6602 and a guide groove 6610.

The locking arm 6602 is provided on one of the side walls 5804 of the slider 58.

The guide groove 6610 is provided on one of the side walls 5404 of the case body 54.

The locking arm 6602 is supported at a base end 6604 thereof for pivotal motion around an axial line extending in the direction perpendicular to the insertion direction at a location of the side wall 5804 of the slider 58.

The locking arm 6602 is disposed such that a free end 6606 thereof is accommodated in and guided by the guide groove 6610.

The guide groove 6610 is provided at a location of the side wall 5404 of the case body 54, and a first locking portion 6612 and a second locking portion 6614 which are lockably engaged by the free end 6606 of the locking arm 6602.

The slider 58 is configured such that, when the free end 6606 of the locking arm 6602 is locked by the first locking portion 6612 as seen in FIG. 9*a* under the biasing force of the biasing element 64, the slider 58 is positioned at the leading end position at which the slider 58 faces the opening 5602 in the slider accommodating chamber 56.

Further, when the free end 6606 of the locking mechanism 66 is lockably engaged with the second locking portion 6614 under the biasing force of the biasing element 64 as seen in FIG. 10A, the slider 58 is positioned at the intermediate position between the leading end position and the trailing end position.

More particularly, if the memory card 10 is inserted into the memory card accommodating chamber 60 of the slider 58 until the slider 58 is pushed in from the leading end position to the trailing end position and then the operator releases the memory card 10, then the slider 58 is positioned at the intermediate position while the free end 6606 of the locking mechanism 66 is locked by the second locking portion 6614. Thus, the slider 58 is held in this state. Then, since the abutting wall 6206 is spaced from the locking portion 6204 when the slider 58 is at the leading end position, the locking portion 6204 is placed in a state wherein it can be resiliently deformed in the widthwise direction of the memory card 10, and consequently, the memory card 10 can be removed.

A plurality of connection terminals 74 are provided on the connector 50 for contacting with the contacts 20 of the contact region 18 of the memory card 10.

In the present embodiment, a plurality of contact portions 7202 for contacting with the contacts 20 are provided in the memory card accommodating chamber 60 while a plurality of deformable portions 7204 connected to the contact portions 7202 are provided in the slider accommodating chamber 56. The deformable portions 7204 are connected to the connection terminals 74.

The contact portions 7202 are each formed from a thin plate having conductivity and resiliency and contact with the contacts 20 when the contact region 18 of the memory card 10 is fitted in the memory card accommodating chamber 60.

Figure 7A:
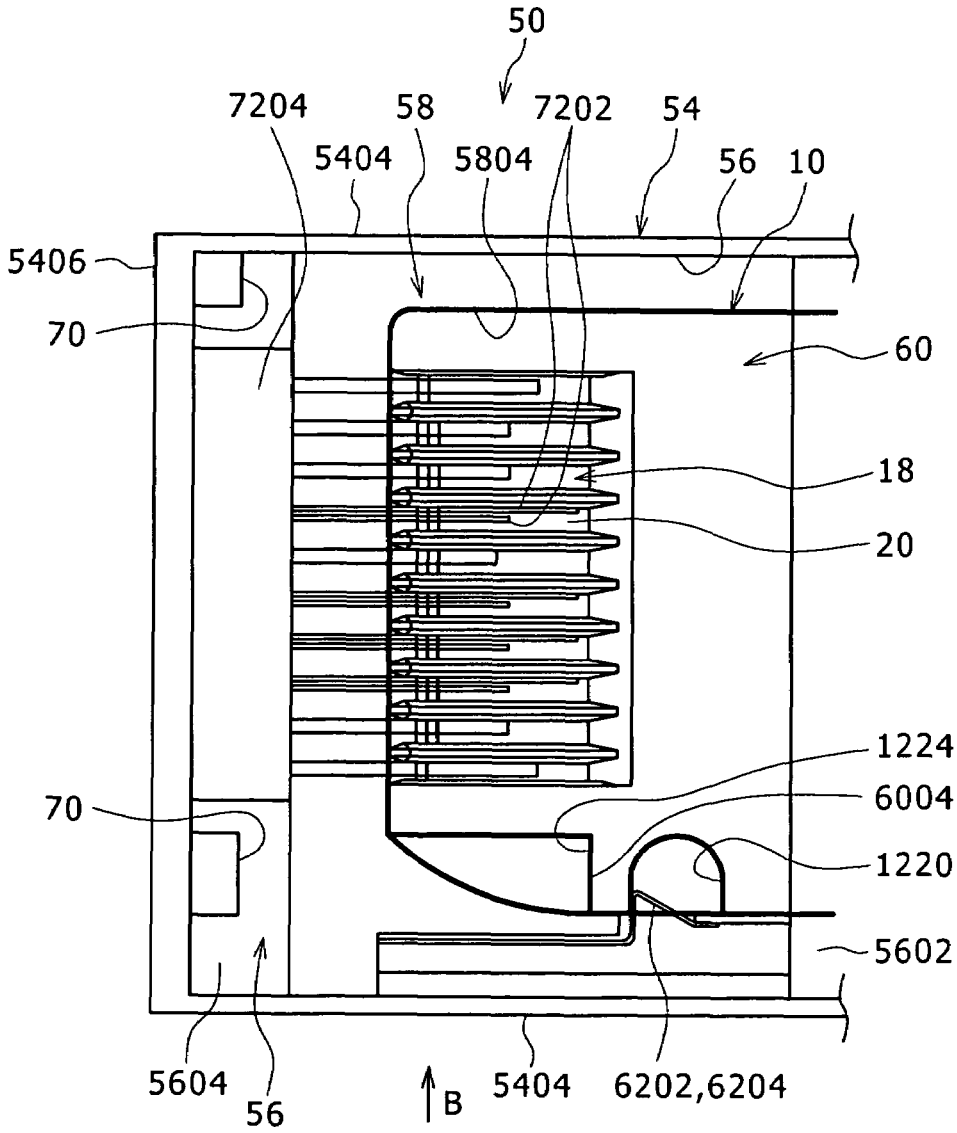
FIG. 7A is a plan view of the connector shown in FIG. 3A into which the memory card of FIG. 1 is inserted and FIG. 7B is a view as viewed in the direction indicated by an arrow mark B in FIG. 7A.
Figure 7B:
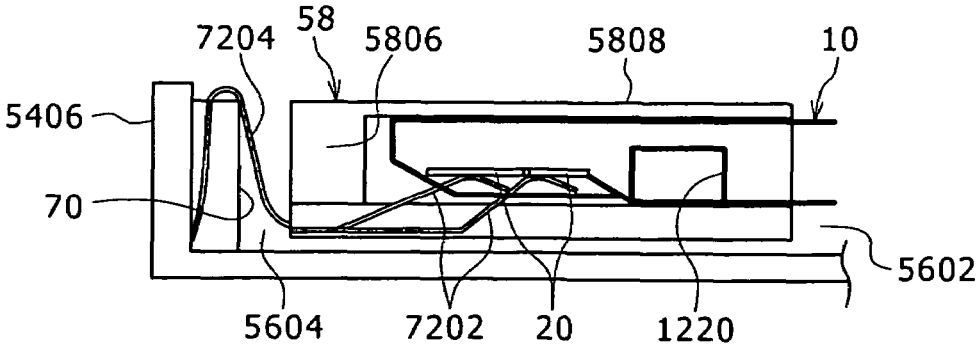

In particular, if the reference face 1224 of the memory card 10 is abutted with the reference face 6004 of the slider 58 as seen in FIGS. 7A, 7B and 9C, then the locking portion 6204 of the slider 58 is lockably engaged with the engaging recess 1220 of the memory card 10 and the contacts 20 of the memory card 10 are electrically connected to the contact portions 7202 of the slider 58.

The contact portions 7202 are described. A contact portion 7202 is provided for each of the first contact 201, second contact 202, sixth contact 206, eighth contact 208 and ninth contact 209 from among the contacts 20 of the memory card 10. Meanwhile, for each of the third contact 203, fourth contact 204, fifth contact 205 and seventh contact 207 of the memory card 10, a contact portion 7202 is provided for each of a first contact and a second contact separated from each other in the direction perpendicular to the insertion direction. The two contact portions 7202 for each of the third contact 203, fourth contact 204, fifth contact 205 and seventh contact 207 are formed as different contact portions having different greater and smaller lengths in the insertion direction depending upon the location at which the contact is provided.

A deformable portion 7204 connects to each of the contact portions 7202 and extends to the outside of the slider 58. Further, the deformable portion 7204 is formed deformable and is disposed in a deformed state in the interior portion 5604 of the slider accommodating chamber 56. In particular, the deformable portion 7204 is deformed in response to movement of the slider 58 such that the size of the mountain of the deformation is maximum when the slider 58 is at the trailing end position at which it is positioned near to the interior portion 5604 of the slider accommodating chamber 56 but the size of the mountain of the deformation is minimum when the slider 58 is at the leading end position at which it is positioned near to the opening 5602.

In the present embodiment, the deformable portions 7204 are formed from a conductive pattern formed on a single flexible board and electrically connected to a portion of the conductive pattern corresponding to the contact portion 7202. A portion of the deformable portion 7204 remote from the contact portion 7202 is formed as a contact terminal 74 which is led out to the outside of the case body 54 through an opening formed in the rear wall 5406 of the case body 54. The contact terminals 74 are electrically connected to a printing circuit board or the like not shown.

It is to be noted that, in the present embodiment, a plurality of slide side contacts, which individually contact with the contacts 20 when the contact region 18 of the memory card 10 is inserted into the memory card accommodating chamber 60, form the contact portions 7202. A contact mechanism for electrically connecting the connection terminals 74 and the slider side contacts described hereinabove is formed by the deformable portions 7204.

Further, in the present embodiment, a restriction section for restricting the trailing end position in which the slider faces a location rather near to the interior portion in the slider accommodating chamber, as defined in the claims, is formed by the stoppers 70. Meanwhile, another restriction section for restricting the leading end position in which the slider faces the opening in the slider accommodating chamber, as defined in the claims, is formed by the first locking portion 6612.

Now, operation is described.

First, operation for fitting the memory card 10 into the connector 50 is described.

Figure 5A:
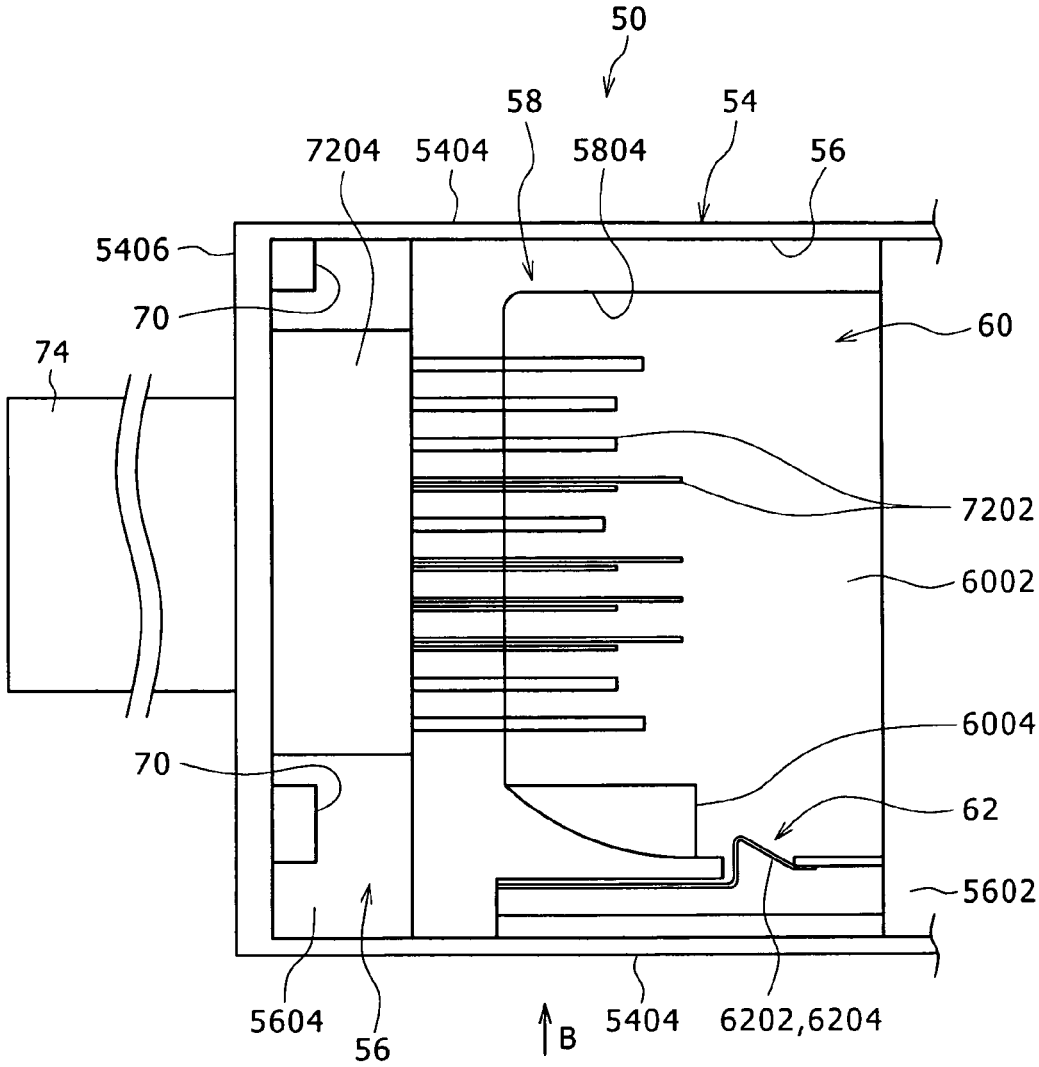
FIG. 5A is a plan view of the connector shown in FIG. 3A
Figure 5B:
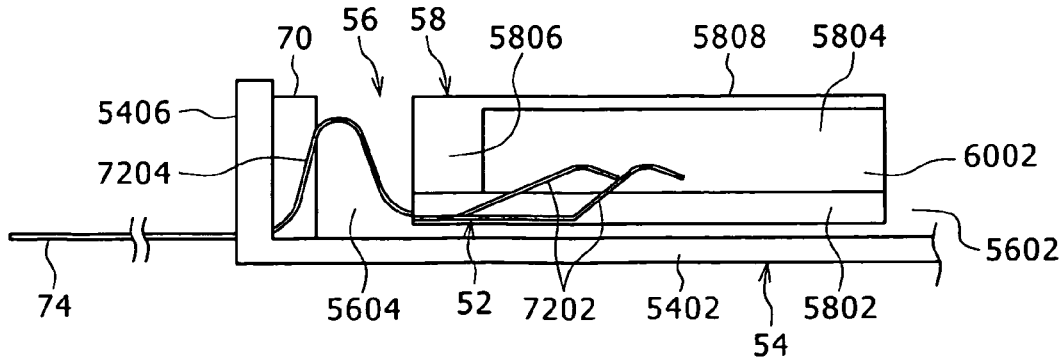
FIG. 5B is a view as viewed in the direction indicated by an arrow mark B in FIG. 5A.
Figure 6A:
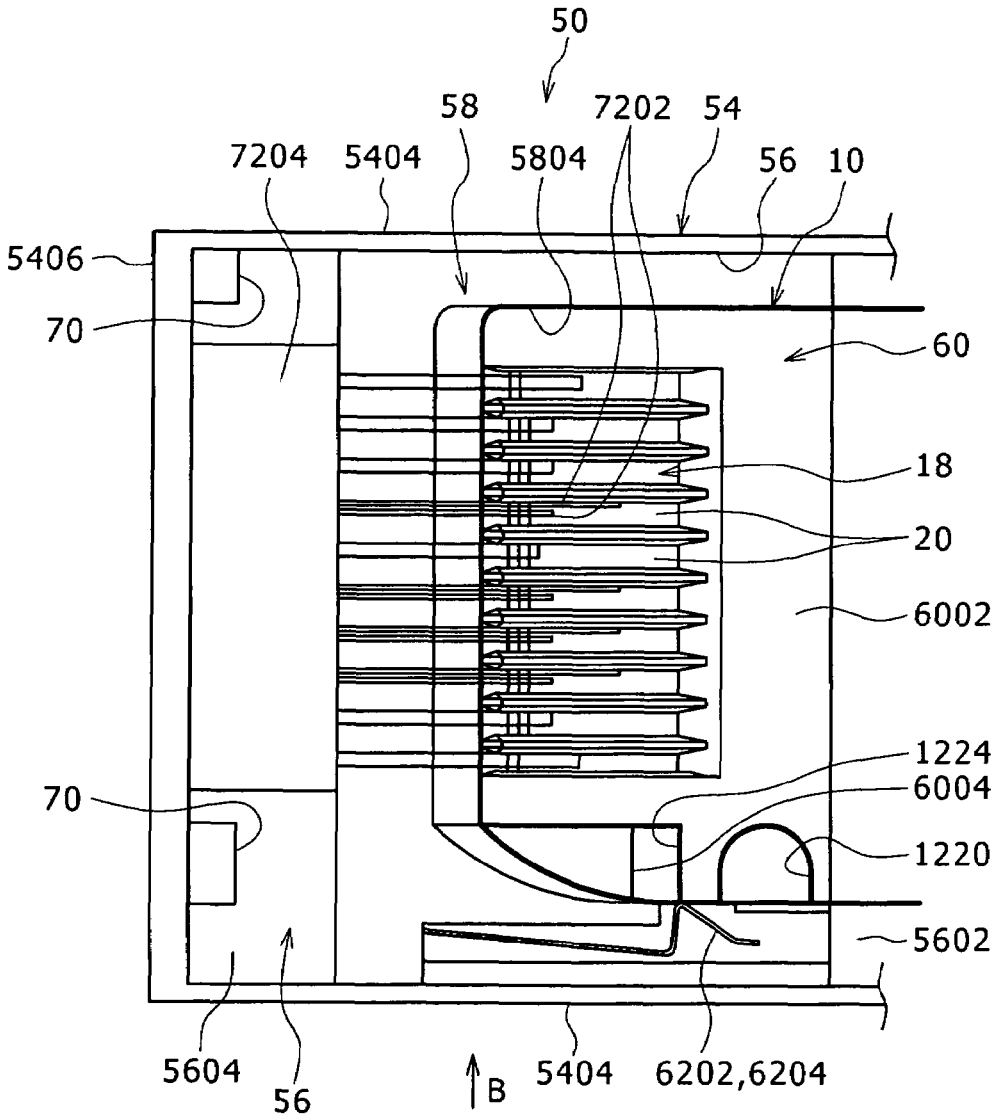
FIG. 6A is a plan view of the connector shown in FIG. 3A into which the memory card of FIG. 1 is inserted and FIG. 6B is a view as viewed in the direction indicated by an arrow mark B in FIG. 6A.
Figure 6B:
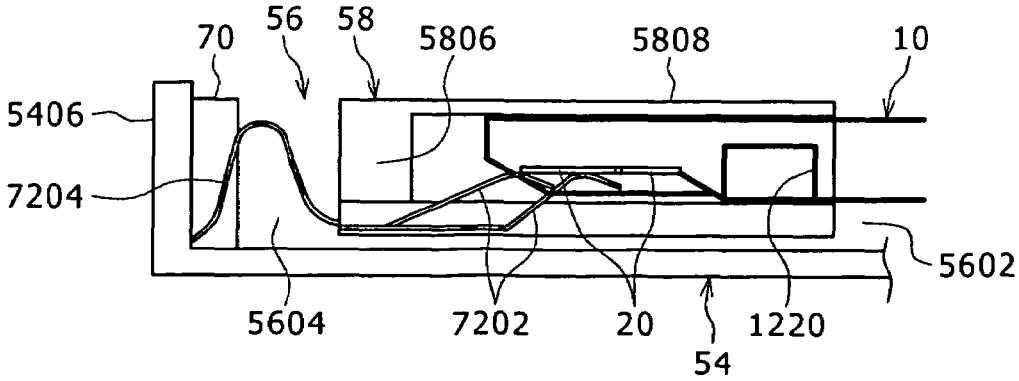

If the memory card 10 is inserted into the memory card accommodating chamber 60 of the slider 58 in a state wherein the slider 58 is positioned at the leading end position as seen in FIGS. 5A, 5B and 9C, then the reference face 1224 of the memory card 10 is moved in a direction in which it approaches the reference face 6004 of the slider 58 as seen in FIGS. 6A, 6B and 9B.

Then, the reference face 1224 of the memory card 10 is abutted with the reference face 6004 of the slider 58 and the locking portion 6204 of the slider 58 is lockably engaged with the engaging recessed portion 1220 of the memory card 10, whereupon the contacts 20 of the memory card 10 are electrically connected to the contact portions 7202 of the slider 58. In particular, a contact portion 7202 is electrically connected with certainty to each of the first contact 201, second contact 202, sixth contact 206, eighth contact 208 and ninth contact 209 from among the contacts 20 of the memory card 10, while two contact portions 7202 (contact portions having greater and smaller lengths in the insertion direction) are electrically connected with certainty to first and second contacts of each of the third contact 203, fourth contact 204, fifth contact 205 and seventh contact 207 of the memory card 10.

Since the memory card 10 and the slider 58 do not thereafter move relative to each other, the electrically connected condition is maintained with certainty.

Figure 8A:
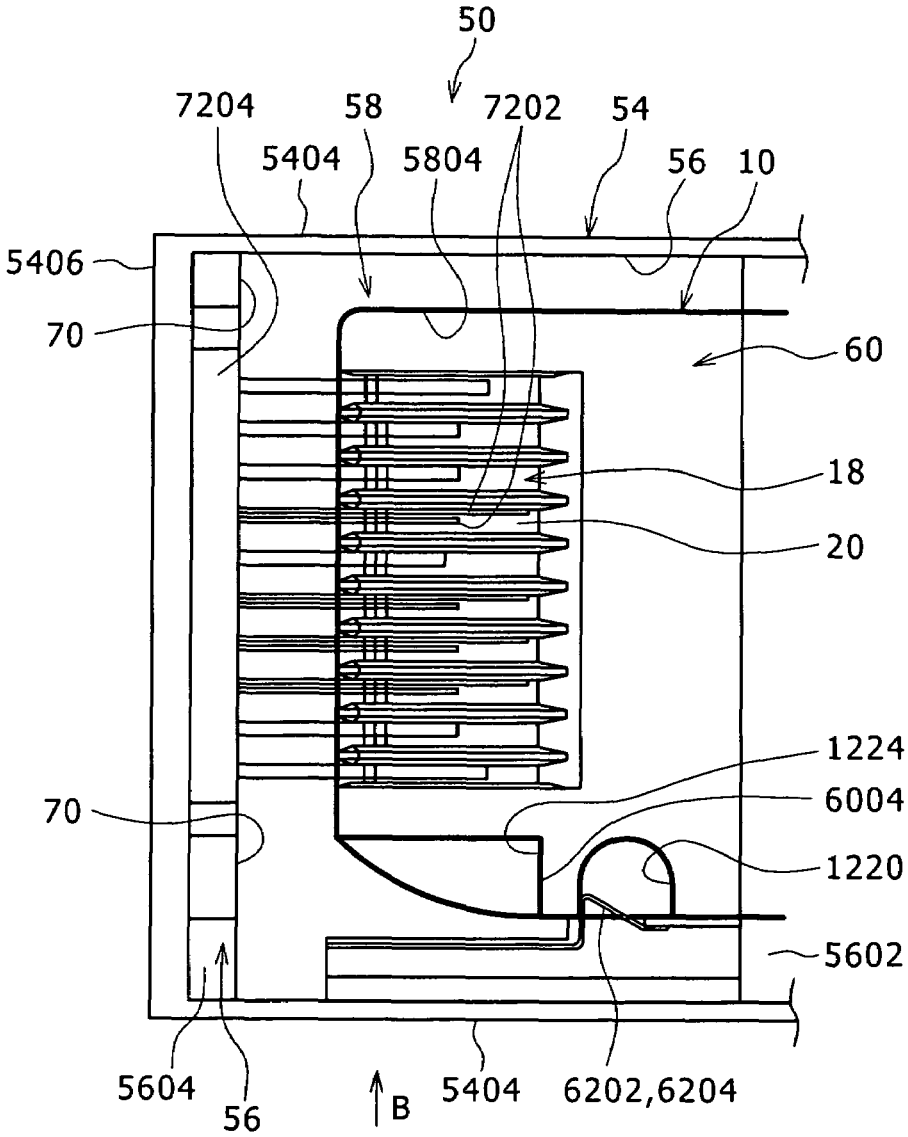
FIG. 8A is a plan view of the connector shown in FIG. 3A into which the memory card of FIG. 1 is inserted and FIG. 8B is a view as viewed in the direction indicated by an arrow mark B in FIG. 8A.
Figure 8B:
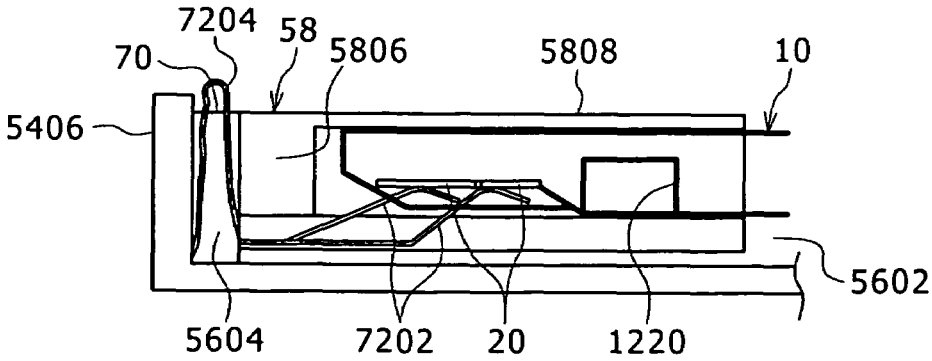

If the memory card 10 is pushed in further in this state, then the slider 58 is pushed in to the trailing end position at which it contacts with the stoppers 70 as seen in FIGS. 8A, 8B and 9D.

Then, if the user releases the memory card 10, then the slider 58 is moved forwardly by the biasing force of the biasing element 64 as seen in FIGS. 8A, 8B and 10A, and the free end 6606 of the locking mechanism 66 is lockably engaged with the second locking portion 6614 and the slider 58 is positioned and thereafter kept positioned at the intermediate position.

Also in the state wherein the slider 58 is positioned at the intermediate position, the contacts 20 of the memory card 10 remain electrically connected to the contact portions 7202 of the slider 58 as described hereinabove.

The memory card 10 is fitted into the connector 50 in such a manner as described above.

Now, operation for removing the memory card 10 from the connector 50 is described.

If the slider 58 is pushed in from the intermediate position to the trailing end position in the state wherein the slider 58 is positioned at the intermediate position as seen in FIGS. 7A, 7B and 10B and then the operator releases the memory card 10, then the slider 58 is moved forwardly by the biasing force of the biasing element 64 as seen in FIG. 10C, and the slider 58 is positioned and thereafter kept positioned at the leading end position in a state wherein the free end 6606 of the locking arm 6602 is lockably engaged with the first locking portion 6612.

At the leading end position, the abutting wall 6206 is spaced from the locking portion 6204 and the locking portion 6204 is resiliently deformable in the widthwise direction of the memory card 10. Consequently, if the memory card 10 is extracted from the memory card accommodating chamber 60 of the slider 58, then the locking of the locking portion 6204 of the slider 58 by the engaging recessed portion 1220 of the memory card 10 is canceled and the memory card 10 is taken out. In the process of the extraction of the memory card 10 from the memory card accommodating chamber 60, the electric connection between the contacts 20 of the memory card 10 and the contact portions 7202 of the slider 58 is cancelled.

The memory card 10 is removed from the connector 50 in such a manner as described above.

According to the present embodiment, the contacts 20 of the memory card 10 and the contact portions 7202 (slider side contacts) of the memory card accommodating chamber 60 are electrically connected to each other with certainty in a state wherein the memory card 10 is fitted in the memory card accommodating chamber 60 of the slider 58. Then, while the electrically connected state is maintained, the slider 58 performs push-in and push-out movements integrally with the memory card 10 (without a relative movement between the slider 85 and the memory card 10). Upon such push-in and push-out movements, the slider 58 and the connection terminals 74 of the connector 50 always remain electrically connected to each other through the deformable portions 7204.

Accordingly, also where the memory card 10 in which the contacts 20 are provided at different locations from each other in the insertion direction is used, since the memory card 10 does not perform push-in and push-out movements to and from the slider 58, the contact portions 7202 and the contacts 20 can be electrically connected to each other with certainty in the slider 58.

Accordingly, even where the memory card 10 in which the contacts 20 are not disposed uniformly is used, electric connection between the contacts 20 of the memory card 10 and the connection terminals 74 of the connector 50 can be maintained with certainty, and advantageously, fitting and removing of the memory card 10 into and from the connector 50 by push-in and push-out operations can be performed with certainty.

Second Embodiment

Now, a connector according to a second embodiment of the present invention is described.

The connector 50 according to the second embodiment has a common configuration to that according to the first embodiment described above except the connection configuration for connecting the connection terminals 74 of the connector 50 and the slide side contacts to each other.

Figure 11A:
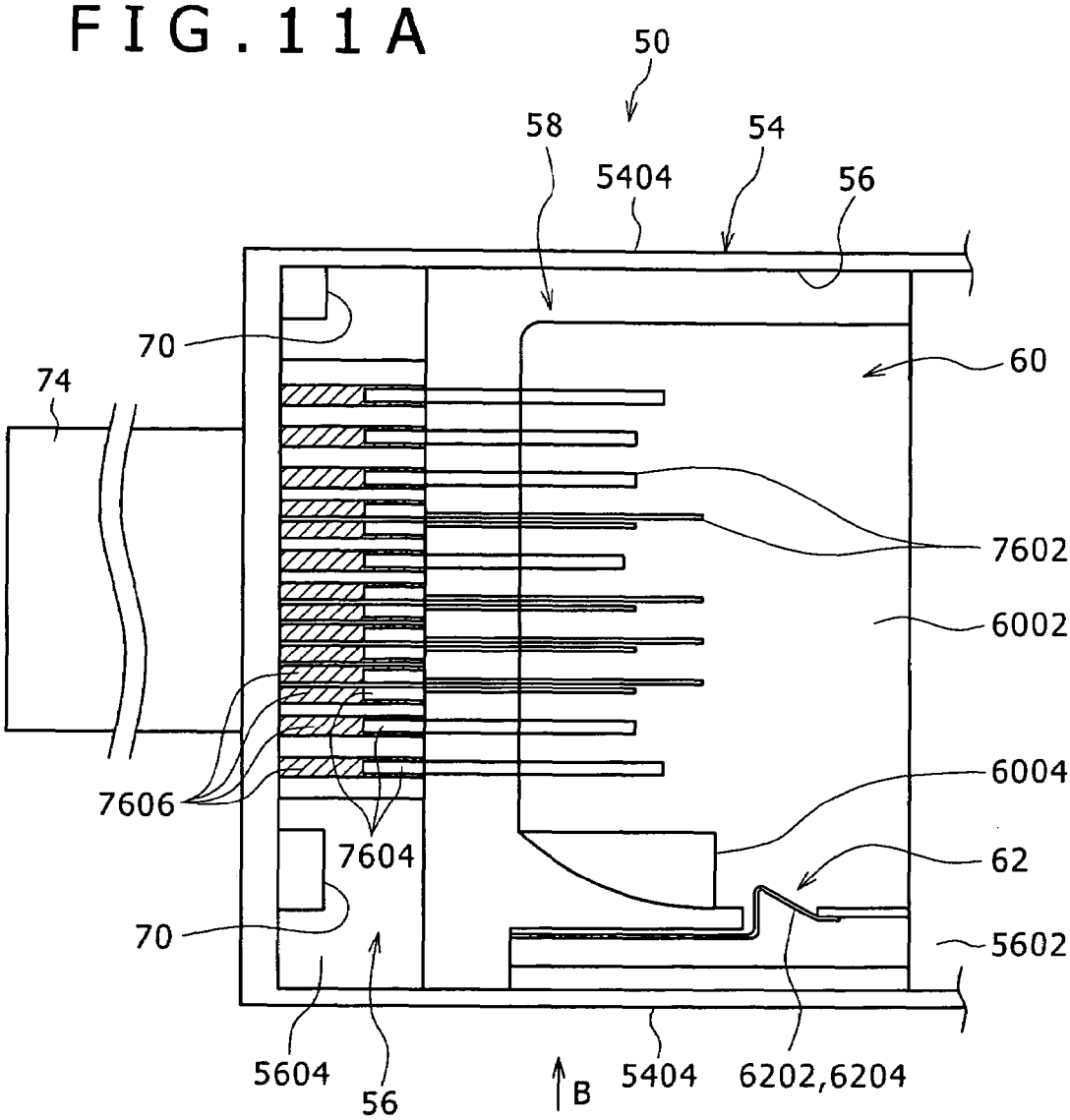
FIG. 11A is a plan view of another connector to which the present invention is applied and FIG. 11B is a view as viewed in the direction indicated by an arrow mark B in FIG. 11A.
Figure 11B:
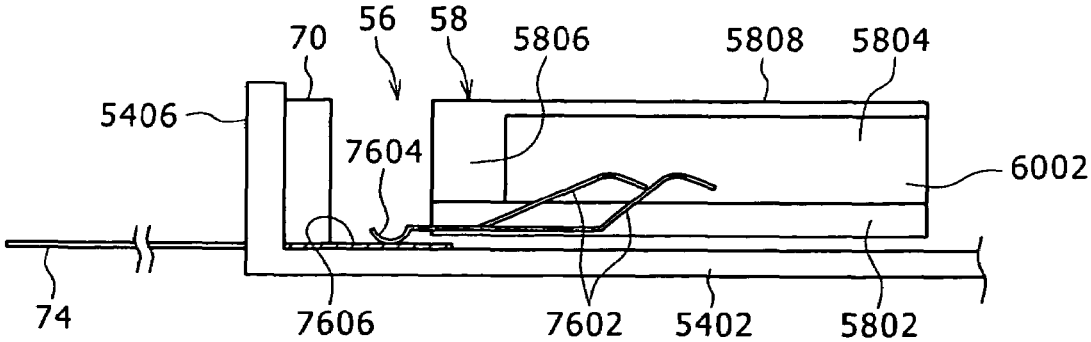
Figure 12A:
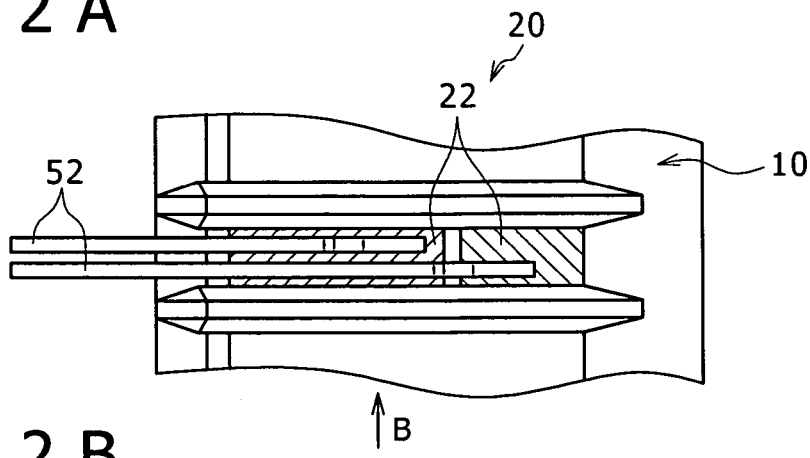
FIG. 12A is a schematic view showing a configuration of a conventional connector and FIG. 12B is a view as viewed in the direction indicated by an arrow mark B of FIG. 12A.
Figure 12B:
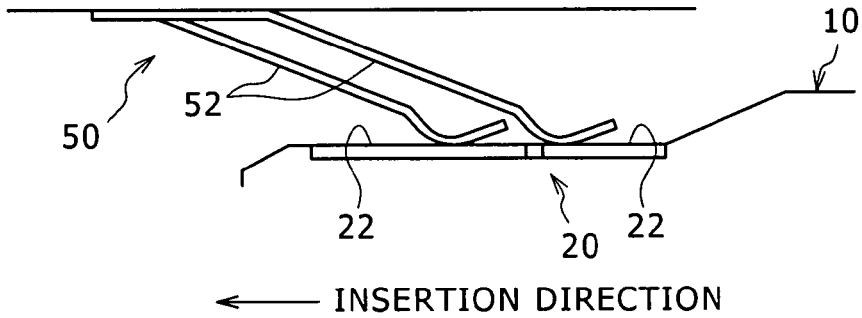
Figure 13A:
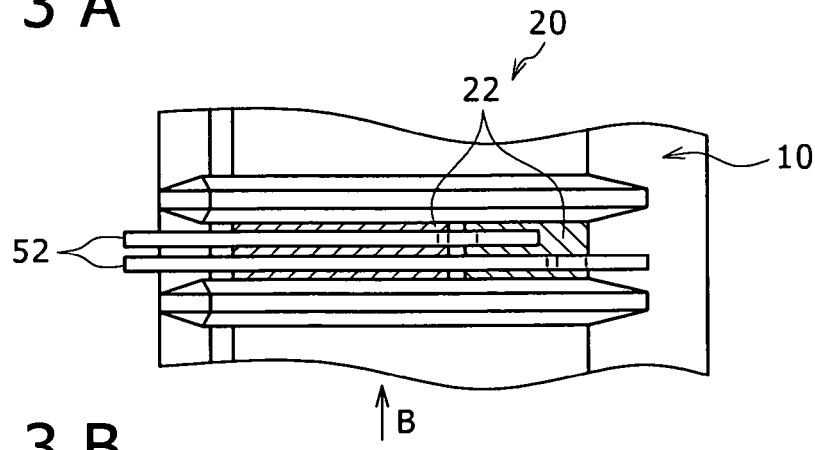
FIG. 13A is a schematic view illustrating a disadvantage which is provided where the conventional connector of FIGS. 12A and 12B is used and FIG. 13B is a view as viewed in the direction indicated by an arrow mark B of FIG. 13A.
Figure 13B:
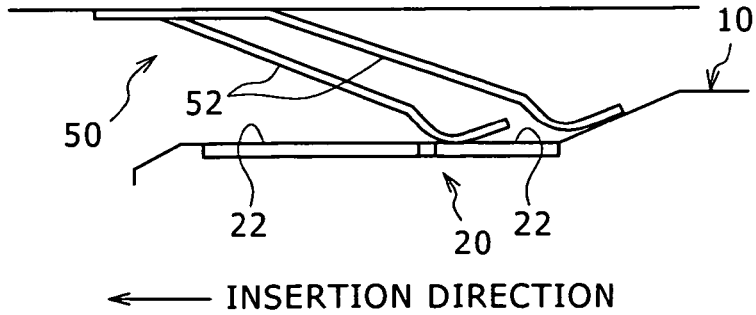

The connector according to the second embodiment is shown in FIGS. 11A and 11B. In the following description, description of the common configuration is omitted to avoid redundancy, but principally only the difference, that is, the connection configuration of the connector 50 according to the second embodiment, is described.

In the connector according to the first embodiment described hereinabove, the slider side contacts which individually contact with the contacts 20 when the contact region 18 of the memory card 10 is inserted into the memory card accommodating chamber 60 are formed from the contact portions 7202 while the connection mechanism for electrically connecting the connection terminals 74 and the slider side contacts described above to each other is formed from the deformable portions 7204. However, in the connector according to the second embodiment shown in FIGS. 11A and 11B, the slide side contacts are formed from internal contact portions 7602 and the connection mechanism is formed from external contact portions 7604 and connector side contact portions 7606.

Referring to FIGS. 11A and 11B, the internal contact portions 7602 are provided in the memory card accommodating chamber 60. The internal contact portions 7602 are formed from a conductive and flexible thin plate and adapted to contact with the contacts 20 when the contact region 18 of the memory card 10 is fitted into the memory card accommodating chamber 60.

More particularly, if the memory card 10 is introduced into the memory card 10 accommodating chamber 60 of the slider 58 in a state wherein the slider 58 is positioned at the leading end position until the reference face 1224 of the memory card 10 is abutted with the reference face 6004 of the slider 58, then the locking portion 6204 of the slider 58 is lockably engaged with the engaging recessed portion 1220 of the memory card 10 and the contacts 20 of the memory card 10 are placed into an electrically connected state to the internal contact portions 7602 of the slider 58.

The internal contact portions 7602 are described. The internal contact portions 7602 are formed similarly to the contact portions 7202 of the connector of the first embodiment, and an internal contact portion 7602 is provided for each of the first contact 201, the second contact 202, the sixth contact 206, the eighth contact 208 and the ninth contact 209 of the contacts 20 of the memory card 10. Meanwhile, an internal contact portion 7602 is provided for each of a first contact and a second contact, which are separated from each other in the direction perpendicular to the insertion direction, of each of the third contact 203, fourth contact 204, fifth contact 205 and seventh contact 207 of the memory card 10. The contact portions 7202 for each of the third contact 203, the fourth contact 204, the fifth contact 205 and the seventh contact 207 are formed as different contact portions having different greater and smaller lengths in the insertion direction depending upon the location at which the contact is provided.

The external contact portions 7604 are provided at a lower portion of the rear wall 5806 of the slider 58. The external contact portions 7604 are formed from a conductive and flexible thin plate and electrically connected to the internal contact portions 7602. Further, the external contact portions 7604 are provided such that they are exposed to the same location in the moving direction of the slider 58 (fitting and removing direction of the memory card 10) from the lower face of the slider 58.

The connector side contact portions 7606 are provided at a location at which the bottom wall 5402 of the slider accommodating chamber 56 faces the external contact portions 7604. The connector side contact portions 7606 are formed from a conductive pattern (or a plurality of conductive thin plates) formed on the bottom wall 5402. The connector side contact portions 7606 contact with the external contact portions 7604 at an intermediate position of the slider 58 and are electrically connected to the connection terminals 74.

In the connector of the second embodiment, in the course of movement of the slider 58 between the leading end position and the trailing end position, the external contact portions 7604 and the connector side contact portions 7606 are always kept in sliding contact with each other to maintain the electric connection therebetween.

According to the configuration described above, similarly as in the case of the connector of the first embodiment, the contacts 20 of the memory card 10 and the internal contact portions 7602 (slider side contacts) of the memory card accommodating chamber 60 are electrically connected to each other with certainty in a state wherein the memory card 10 is fitted in the memory card accommodating chamber 60 of the slider 58. Further, the slider 58 performs push-in and push-out movements integrally with the memory card 10 (while the slider 58 and the memory card 10 do not move relative to each other). Further, upon such push-in and push-out movements, the internal contact portions 7602 of the slider 58 and the contact terminals 74 of the connector 50 always remain in electrical contact with each other through the external contact portions 7604 and the connector side contact portions 7606.

Accordingly, even where the memory card 10 in which the contacts 20 are not disposed uniformly as in the case wherein the contacts 20 are provided at different positions in the insertion direction is used, since the memory card 10 does not perform push-in and push-out movements with respect to the slider 58, electric contact between the contacts 20 of the memory card 10 and the connection terminals 74 of the connector 50 is maintained with certainty whereas fitting and removing of the memory card 10 into and from the connector 50 by such push-in and push-out operations can be performed with certainty.

It is to be noted that, while, in the embodiments described above, the locking mechanism 66 for moving, when the slider 58 is pushed in from the leading end position to the trailing end position, the slider 58 from the trailing end position and locking the slider 58 at the intermediate position between the leading end position and the trailing end position and then canceling the locking when the slider 58 is pushed in again from the intermediate position is formed from the locking arm 6602 and the guide groove 6610, the locking mechanism for such push-in and push-out movements is not limited to that of the embodiments described above, but various known mechanisms can be adopted for the locking mechanism.

Further, the configuration of the connection mechanism for connecting a plurality of connection terminals and a plurality of slider side contacts is not limited to those of the first and second embodiments, but various known mechanisms can be adopted for the connection mechanism.

While preferred embodiments of the present invention have been described using specific terms, such description is for illustrative purpose only, and it is to be understood that changes and variations may be made without departing from the spirit or scope of the following claims.

What is claimed is:

1. A connector for contacting a plurality of contacts of a memory card comprising:

case body having a slider accommodating chamber; and a slider within the slider accommodating chamber having a memory card accommodating chamber and a plurality of electrical connectors disposed therein, wherein the plurality of contacts of the memory card and corresponding electrical connectors in the slider memory card accommodating chamber are in electrical communication and maintain a substantially fixed relationship even when the slider moves within the case body.

2. A connector for contacting a plurality of contacts of a memory card as in claim 1 further comprising:

the memory card accommodating chamber provided inside said slider; wherein electrical connectors inside the memory card accommodating chamber corresponding to electrical contacts of the memory card are disposed in fixed positions relative to the slider inside said memory card accommodating chamber, and wherein a plurality of external contact portions are disposed outside of said slider and are in electrical communication with the electrical connectors inside said memory card accommodating chamber.

3. A connector for contacting a plurality of contacts of a memory card as in claim 1 further comprising:

a biasing means for biasing the slider toward an initial position of the case body such that as the slider traverses the case body from the initial position to a tailing position opposite the leading position, the biasing means biases the slider toward the initial position.

4. A connector for contacting a plurality of contacts of a memory card as in claim 1 further comprising:

a locking and unlocking means for locking the slider in an intermediate position within the case body after the slider is moved from an initial position toward a tailing position, located opposite the initial position, past the intermediate position, and for unlocking the slider from the intermediate position after the slider is moved from the locked intermediate position toward the tailing position.

5. A connector for contacting a plurality of contacts of a memory card as in claim 1 further comprising:

a plurality of external contact portions disposed outside of said slider in electrical communication with said electrical connectors; and a memory card retaining means disposed within the slider for retaining a memory card inserted into the memory card accommodating chamber.

6. A connector for contacting a plurality of contacts of a memory card as in claim 1 further comprising:

a memory card retaining means disposed within the slider for retaining a memory card inserted into the memory card accommodating chamber, wherein the memory card retaining means temporarily fixes the memory card within the memory card accommodating chamber in a state where the electrical connectors of the slider accommodating chamber are in electrical communication with contacts of the memory card such that when the slider is moving, the connectors of the memory card accommodating chamber and the contacts of the memory card remain in electrical communication.

7. A connector for contacting a plurality of contacts of a memory card as in claim 1 further comprising:

a first reference element disposed inside the memory card accommodating chamber corresponding to a second reference element of the memory card;

wherein after the memory card is inserted into the slider memory card accommodating chamber, the first reference element engages the second reference element preventing further insertion of the memory card into the memory card accommodating chamber.

8. A connector for contacting a plurality of contacts of a memory card as in claim 1 further comprising a plurality of deformable contact elements individually in electrical communication with the electrical connectors of the memory card accommodating chamber which reach an external portion of said slider;

wherein said electrical connectors are conductive flexible plates and said deformable contact elements are a conductive pattern formed on a flexible board.

9. A connector for contacting a plurality of contacts of a memory card as in claim 1 further comprising:

a memory card retaining means disposed in the slider reaching the memory card accommodating chamber for retaining the memory card in the memory card accommodating chamber;

said memory card retaining means including a spring for engaging a recessed portion of the memory card when the memory card is inserted into said memory card accommodating chamber; such that the memory card retaining means lockably engages the memory card when the slider is in a position other than the initial position.

10. A connector for contacting a plurality of contacts of a memory card as in claim 1 further comprising:

a memory card retaining means disposed in the slider reaching the memory card accommodating chamber for retaining the memory card in the memory card accommodating chamber;

said memory card retaining means including a spring for engaging a recessed portion of the memory card when the memory card is inserted into said memory card accommodating chamber; such that the memory card retaining means lockably engages the memory card when the slider is in a position other than the initial position; and a biasing means for biasing the slider towards and initial position.

11. A connector for contacting a plurality of contacts of a memory card as in claim 1 further comprising a memory card retaining means disposed in the slider reaching the memory card accommodating chamber for retaining the memory card in the memory card accommodating chamber;

said memory card retaining means including a spring for engaging a recessed portion of the memory card when the memory card is inserted into said memory card accommodating chamber; such that the memory card retaining means lockably engages the memory card when the slider is in a position other than the initial position, wherein said spring is disposed in said slider for resilient deformation, said slider accommodating chamber having an abutting wall provided therein for abutting said spring member to block resilient deformation of said spring member when said slider is in a position other than the initial position.

12. A connector for contacting a plurality of contacts of a memory card as in claim 1 further comprising a memory card retaining means disposed in the slider reaching the memory card accommodating chamber for retaining the memory card in the memory card accommodating chamber;

said memory card retaining means including a spring for engaging a recessed portion of the memory card when the memory card is inserted into said memory card accommodating chamber; such that the memory card retaining means lockably engages the memory card when the slider is in a position other than the initial position, wherein said spring is disposed on said slider for resilient deformation, said slider accommodating chamber having an abutting wall provided therein for abutting said spring member to block resilient deformation of said spring member when said slider is in a position other than the initial position; and a biasing means for biasing the slider towards the initial position.

13. A method for retaining and releasing a memory card within a memory card accommodating chamber of a slider comprising;

inserting a memory card into a memory card accommodating chamber of a slider when the slider is in an initial position, wherein the slider is disposed within a case body;

engaging a memory card retaining means, temporarily fixing the memory card inside the memory card accommodating chamber of the slider, and establishing electrical communication between connectors disposed within the slider accommodating chamber and contacts of the memory card;

moving the slider and memory card from an initial position within the case body such that the retaining means prevents the memory card from disengaging the slider when the slider is in a position other than the initial position;

wherein the contact relationship between electrical contacts within the memory card accommodating chamber and electrical contacts of the memory card is substantially fixed even when the slider is moved;

returning the slider to the initial position;

disengaging the retaining means, releasing the memory card; and removing the memory card from the memory card accommodating chamber.

14. A method for maintaining electrical communication between a plurality of connectors and a connection terminal comprising:

inserting a memory card into a memory card accommodating chamber of a slider having internal electrical connectors disposed within the memory card accommodating chamber fixed relative to the slider, and having external electrical connectors disposed outside of the slider wherein the internal electrical connectors are in electrical communication with the external electrical connectors, such that electrical contacts of the memory card are in electrical communication with the internal electrical connectors; and moving the slider within a case body wherein the external electrical connectors are in electrical communication with the connection terminal of the case body, and the internal electrical connectors maintain a fixed relationship with the memory card contacts while maintaining electrical communication with the memory card contacts even when the slider is moved.

* * * * *